United States Patent [19]

Lodge

[11] 4,015,907

[45] Apr. 5, 1977

[54] FLUID APPLICATORS

[76] Inventor: Guy Bryan Lodge, Island Farm Ave., West Molesey, Surrey, England

[22] Filed: Oct. 9, 1975

[21] Appl. No.: 621,124

Related U.S. Application Data

[63] Continuation-in-part of Ser. No. 564,333, April 2, 1975, abandoned.

[30] Foreign Application Priority Data

July 7, 1975 United Kingdom ..... 15268/75

[52] U.S. Cl. ..... 401/48; 401/206; 401/208; 401/218

[51] Int. Cl.[2] ..... A46B 11/00; B44D 3/22

[58] Field of Search ..... 401/48, 206, 218, 281, 401/188, 140, 270, 208

[56] References Cited

UNITED STATES PATENTS

| | | | |
|---|---|---|---|
| 1,503,556 | 8/1924 | Rhien | 401/270 X |
| 2,745,127 | 5/1956 | Wulf | 401/48 |
| 2,833,073 | 5/1958 | Doggett | 401/218 X |
| 2,988,763 | 6/1961 | Sweet | 401/48 |
| 3,037,235 | 6/1962 | Goggans | 401/48 |
| 3,134,327 | 5/1964 | Sebanc | 401/218 |
| 3,230,570 | 1/1966 | Flippen | 401/206 |
| 3,356,442 | 12/1967 | Leland | 401/206 |

FOREIGN PATENTS OR APPLICATIONS

| | | | |
|---|---|---|---|
| 416,210 | 11/1946 | Italy | 401/218 |

*Primary Examiner*—Lawrence Charles
*Attorney, Agent, or Firm*—Cooper, Dunham, Clark, Griffin & Moran

[57] ABSTRACT

A fluid applicator for applying fluid to a surface has a reservoir for fluid. An outlet from the reservoir leads to a roller assembly comprising at least two rollers which are arranged to roll over the surface to be marked so as to apply fluid from the reservoir to the surface in a single line. The roller assembly is removably mounted between side frame members and the surface of each roller is framed by a peripheral sleeve of an absorbent material. The sleeve can then be removed from the applicator for renewal or cleaning.

21 Claims, 10 Drawing Figures

FLUID APPLICATORS

This is a continuation-in-part of my U.S. Pat. application Ser. No. 564,333 filed Apr. 2, 1975, now abandoned.

BACKGROUND TO THE INVENTION

This invention relates to a fluid applicator which can be used as a line marker for marking lines, for example, of paint, on a surface.

On conventional fluid applicators a single roller is used to transfer fluid from a reservoir or from a transfer roller to the ground. In this known applicator the use of a single roller to mark a line on the ground has the disadvantage that the line drawn by the roller may not be a continuous line if some part of the rollers surface is not sufficiently filled with fluid.

STATEMENT OF THE INVENTION

According to one aspect of the present invention a fluid applicator for applying fluid to a surface comprises a reservoir for fluid, a fluid outlet in the reservoir, two side frame members, at least one roller assembly mounted between the side frame members, the or each assembly comprising at least two rollers, at least one of which is situated so as to receive fluid from the outlet, at least two of the rollers being arranged one behind the other so as to roll over the surface to be marked and to apply the fluid to the surface in a single line, each roller comprising a spindle and a cylindrical sleeve of an absorbent material removably mounted on the spindle, the ends of each spindle being journalled in respective side frame members, means releasably connecting at least one of said side frame members to said spindle whereby said side frame can be removed to permit said sleeve to be removed from a respective spindle for cleaning or replacement.

The fact that two rollers are provided for rolling over the surface to be marked ensures that a good continuous line is made on the surface.

Each assembly may include an additional roller mounted with its periphery in contact with the peripheries of the said two rollers, and which is situated to receive fluid from the outlet and to transfer it to the said two rollers.

The fluid applicator may include two roller assemblies which may be situated one behind the other or one alongside the other, and the two assemblies may be mounted independently of one another so as to take up un-evenness in the surface being marked.

The periphery of the rollers is preferably of a foam plastics material which can easily be replaced if it becomes clogged with fluid.

The flow of fluid from the reservoir may be controlled by means of a trigger which can be situated adjacent a handle for manipulating the applicator. In such an embodiment the fluid applicator can be rolled along the ground by an operator who need only use one hand.

According to a second aspsct of the invention there is provided a fluid applicator for applying fluid to a surface, comprising a reservoir for fluid, fluid outlet means in the reservoir and at least two roller assemblies, each assembly comprising at least two rollers one of which is situated to receive fluid from said outlet means, two of the rollers in each assembly being situated one behind the other so as to roll over the surface to be marked and to apply the fluid to the surface in a single line, and means permitting one roller assembly to move vertically with respect to the other roller assembly to accommodate un-evenness in the surface being marked.

DESCRIPTION OF THE PREFERRED EMBODIMENTS

Figure 1:
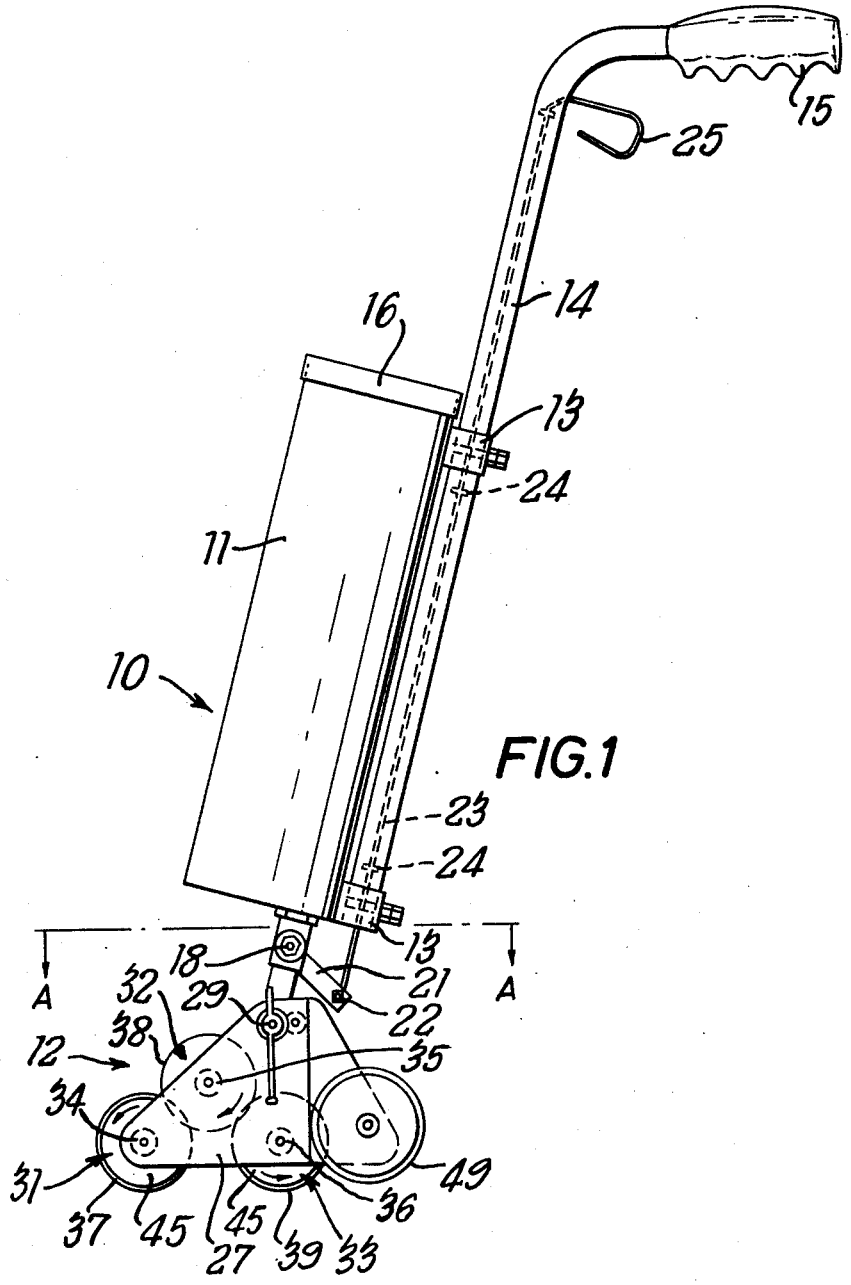
FIG. 1 is a side view of a fluid applicator according to the present invention.
Figure 2:
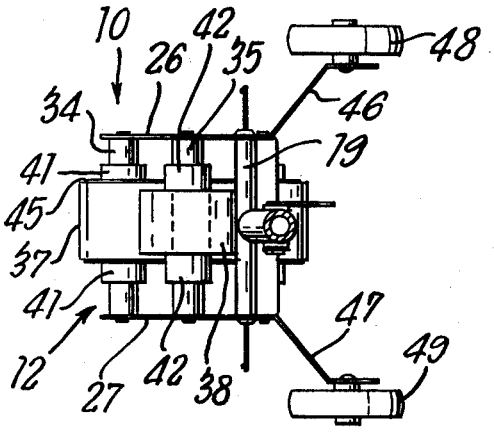
FIG. 2 is a section on the line A—A of FIG. 1.
Figure 3:
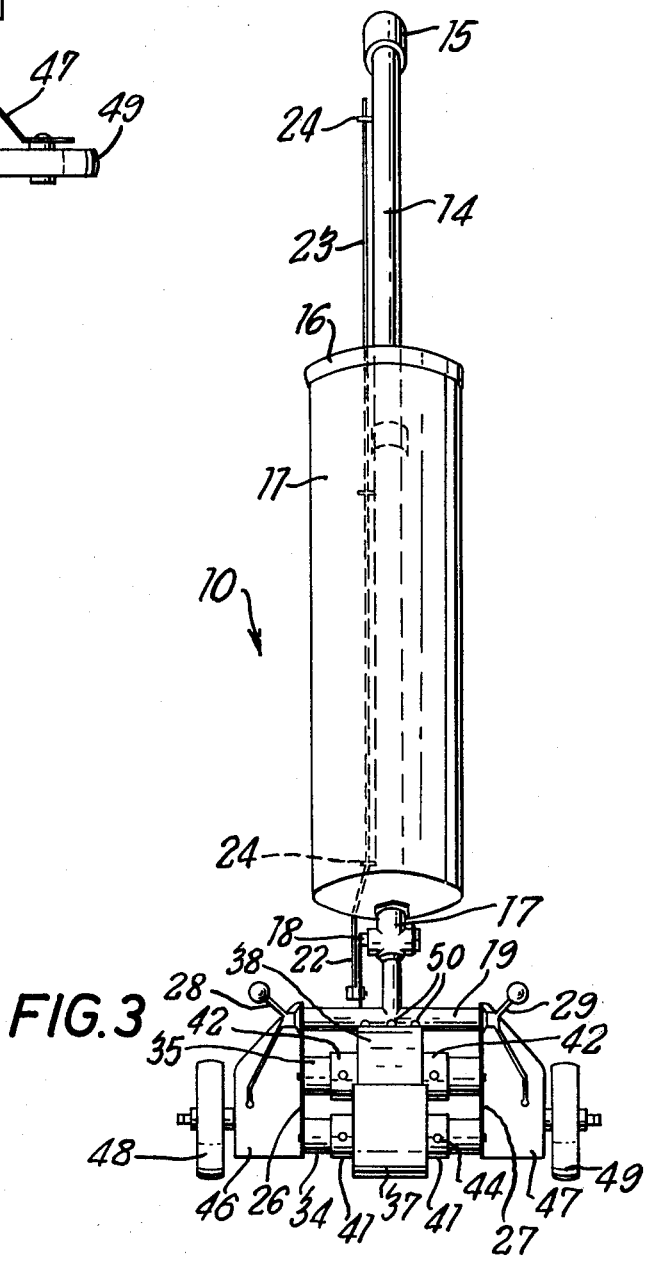
FIG. 3 is a front elevation of the fluid applicator of FIG. 1.

In FIGS. 1 to 3 of the drawings a fluid applicator is indicated generally at 10 and includes a cylindrical tank 11 for the fluid to be applied and, situated beneath the tank 11, a triple roller unit 12. The tank 11 is mounted by means of flanges 13 to an upright member 14 which terminates in a handle 15. The tank 11 has a cover 16 at its upper end and an outlet 17 at its lower end.

The outlet 17 is opened and closed by means of a rotatable valve member 18 which permits free flow of fluid from the tank 11 to a spreader tube 19 in one rotational position but cuts off the flow in another rotational position. The valve member 18 is moved between these two rotational positions by means of a linkage comprising a lever 21 rigidly connected at one end to the valve member 18 and pivotally connected at the other end 22 to a rod 23. The rod 23 passes upwardly through eyelets 24 fixed to the upright member 14 and terminates in a trigger 25 which is situated adjacent the handle 15. In the position shown in FIG. 1 the outlet 17 from the tank 11 is closed but if the trigger 25 is moved upwardly the lever 21 will pivot in an anti-clockwise direction (as seen in FIG. 1) and the valve member 18 will be rotated so as to open the outlet. When the trigger 25 is released the rod 23 will move under gravity to its initial position so as to close the outlet.

Two substantially triangular plates 26, 27 are used to support the triple roller unit 12 and the spreader tube 19. The tube 19 is non-rotatably mounted between the upper ends of the plates 26, 27 by means of removable wing nuts 28, 29.

The triple roller unit 12 comprises three roller assemblies 31, 32, 33 each of which includes a shaft 34, 35, 36 respectively, the ends of which are rotatably journalled in apertures in the plates 26, 27.

Tubular members 37, 38, 39 are situated centrally of the shafts 34, 35, 36 respectively and form the rolling surface of the roller units. The tubular members are of a foam plastics material. Each tubular member is appropriately positioned on its respective shaft by pairs of sleeves 41, 42, 43 which are attached to the respective shafts by screws 44. Discs 45 are positioned at the ends of the tubular members 37 and 39 to ensure that these members, which are to contact the surface to be marked, do not become mis-shapen during use. It will be seen from FIG. 1 that the roller units are positioned so that the periphery of the tubular member 38 contacts the periphery of the tubular members 37 and 39.

Each plate 26, 27 has a portion 46, 47 respectively which is inclined rearwardly and outwardly of the applicator and which carries a wheel 48, 49 respectively by means of which the applicator can be moved over the surface to be marked.

In operation the applicator is wheeled over the surface by the handle 15. When lines are to be marked the valve trigger 25 is moved upwardly towards the handle 15 causing the lever 21 to move upwardly thus rotating the valve member 18 and opening the flow path between the tank 11 and the spreader tube 19. Fluid flows by gravity into the tube 19 and flows from the tube 19 via holes 50 onto the periphery of the foam tubular member 38 of the roller assembly 32. As the applicator moves over the surface to be marked the roller assembly 33 will rotate in an anti-clockwise direction (as seen in FIG. 1) as it is in contact with the surface. Contact between the tubular members 39 and 38 will transfer fluid from the member 38 to the member 39 and contact between the members 37 and 38 will ensure that fluid from member 38 is transferred to the member 37. Thus as the applicator moves over the surface a single line will be marked on the surface by contact between the fluid laden members 37, 39 and the surface to be marked. The fact that the members of the two roller assemblies 31, 33 are in contact with the surface ensures that a good, cntinuous line is made since both assemblies are applying fluid to the surface.

If the foam tubular members become clogged with fluid such as paint they may be removed and replaced. To remove the foam tubular members, all that has to be done is to remove the wing nuts 28 and 29 when the side plates 26 and 27 may be removed since the shafts 34, 35 and 36 merely engage apertures in the plates and are not secured thereto. It is possible to construct the applicator so that only one side plate need be removed. This will give access to the roller unit and permit the tubular members to be removed for cleaning or renewal.

Figure 4:
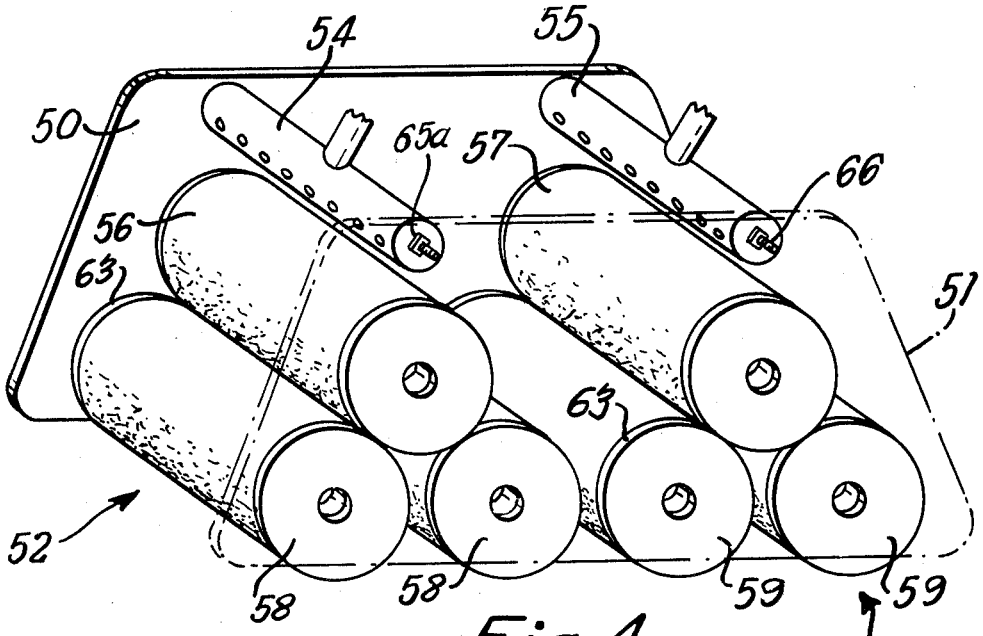
FIG. 4 is a partial perspective view of a modified fluid applicator having two triple roller units.
Figure 5:
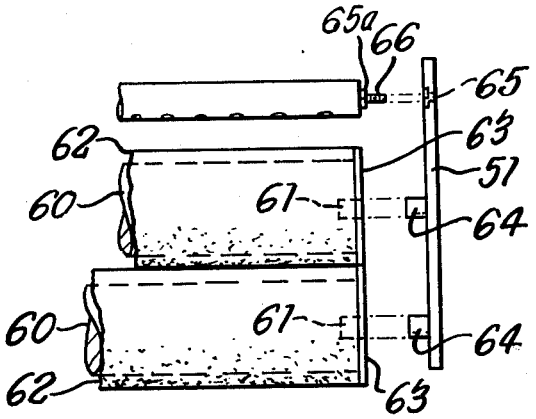
FIG. 5 is a front elevation of part of the fluid applicator of FIG. 4.

A part of a modified fluid applicator is indicated in FIGS. 4 and 5. FIG. 4 shows side plates 50, 51 which corresponds to the side plates 26, 27 respectively of the applicator shown in FIGS. 1 to 3. Between the plates 50 and 51 are two triple roller units 52 and 53 and associated with each unit is a spreader tube 54, 55 respectively. The spreader tubes are situated at the base of a tank which is not shown but which is similar to the tank 10 of FIGS. 1 to 3. The flow of paint to the tubes 54 and 55 may be controlled by a single valve similar to that shown in FIGS. 1 to 3, or there may be two valves each controlling the flow to a separate spreader tube.

The side plates 50, 51 may have rearward extensions carrying wheels as in the embodiment of FIGS. 1 to 3 or the wheels may be attached directly to the plates 50, 51.

The spreader tubes 54 and 55 are situated so as to permit paint to flow under gravity to the top-most roller 56, 57 of each roller unit. As described in the previous embodiment, forward movement of the fluid applicator over the surface to be marked causes the paint from the top-most roller 56, 57 to be transferred to the two lower rollers 58, 59 of each unit, the lower rollers being in contact with the surface to be marked. Since the rollers 59 are situated directly behind the rollers 58, the line is drawn with four rollers thus ensuring that a good continuous line is obtained.

The rollers may be constructed as shown in the previous embodiment but as shown in FIGS. 4 and 5 each roller has a central member 60 (FIG. 5) with a recess 61 at each end. A tubular sleeve 62 of foamed plastics material is fitted over each member 60 and an end plate 63 having an aperture co-operating with the recess 61 is fitted over each end of each roller.

Each side plate 50, 51 is provided with spigots 64 which fit into the recesses 61, and with a square aperture 65 which receives a complementarily shaped member **65*a* situated at each end of each spreader tube 54, 55. The spreader tube is thus prevented from rotating relative to the side plates. The member 65*a* continues in the form of a screw-threaded member 66 so that when nuts (not shown) are screwed onto the members 66 the two triple roller units 52 and 53 are securely and non-rotatably retained between the side plates 50, 51.**

In a modified embodiment, the spreader tubes and central members 60 are rigid with the side plate 50 and only the side plate 51 is provided with recesses 65 and spigots 64. Thus when the sleeves 62 have to be cleaned it is only necessary to remove the plate 51 to obtain access to the sleeves 62 which can then be removed from the central members 60 for cleaning or replacement.

The embodiment of FIGS. 6 to 10 comprises three triple roller units 70, 71, 72. The front roller unit 70 is constructed in the same way as those described with reference to FIGS. 4 and 5 and has an associated spreader tube 73. The two rear roller units 71, 72 are mounted between side plates 74 so that one roller of each unit is co-linear with the corresponding roller of the other unit. It will be seen from FIGS. 6 and 7 that the units 71 and 72 are spaced apart and that the unit 70 is situated so as to overlap that space and a part of each of the units 71, 72. This arrangement ensures that the three units together are able to make a wide continuous line.

The units 71, 72 have a spreader tube 75 between them and the two spreader tubes 73, 75 may be controlled separately or together as described in relation to the spreader tubes 54, 55 of FIG. 4.

By altering the position of the retaining sleeves 76 on the shaft 77 variations in the width of the line to be marked may be achieved.

Figure 6:
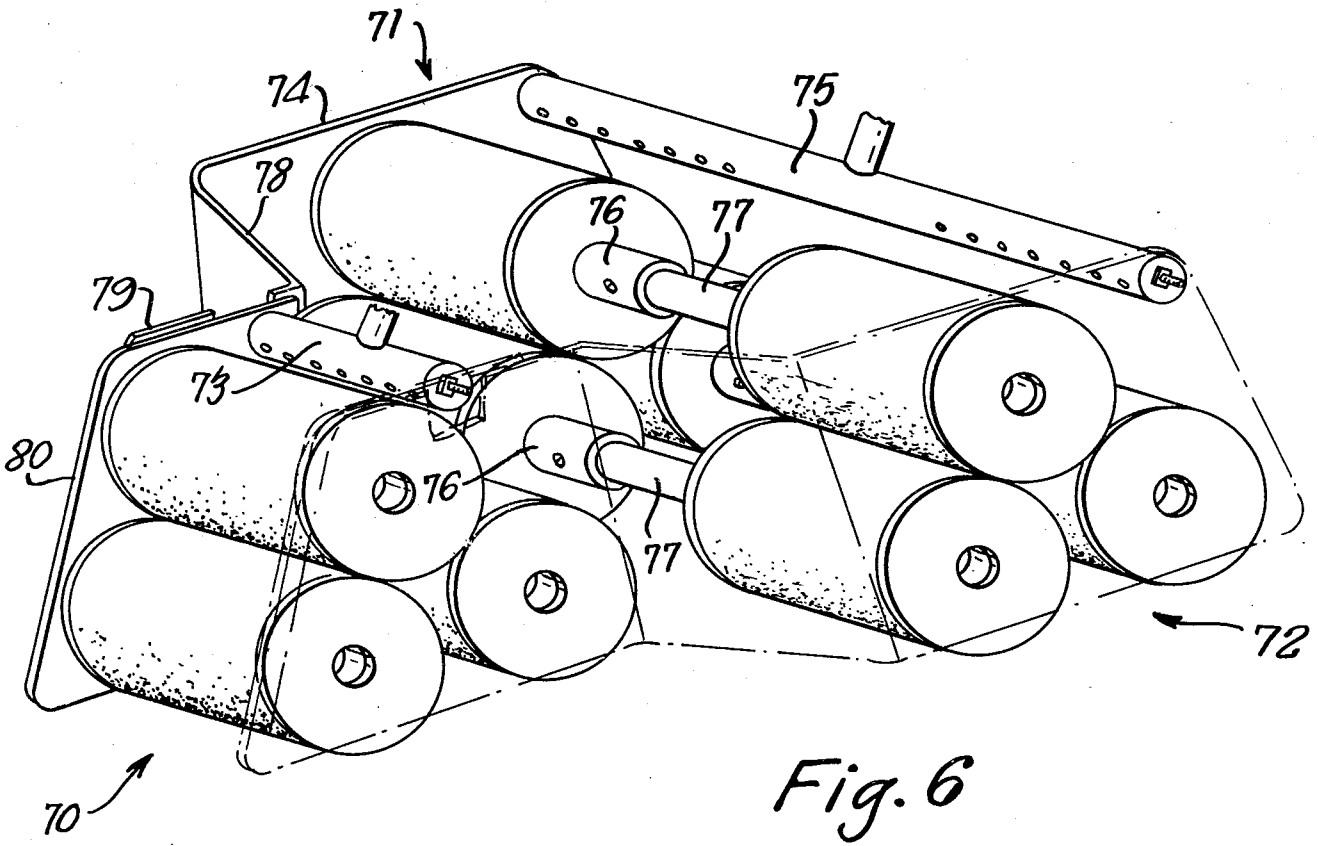
FIG. 6 is a partial perspective view of a further fluid applicator.
Figure 7:
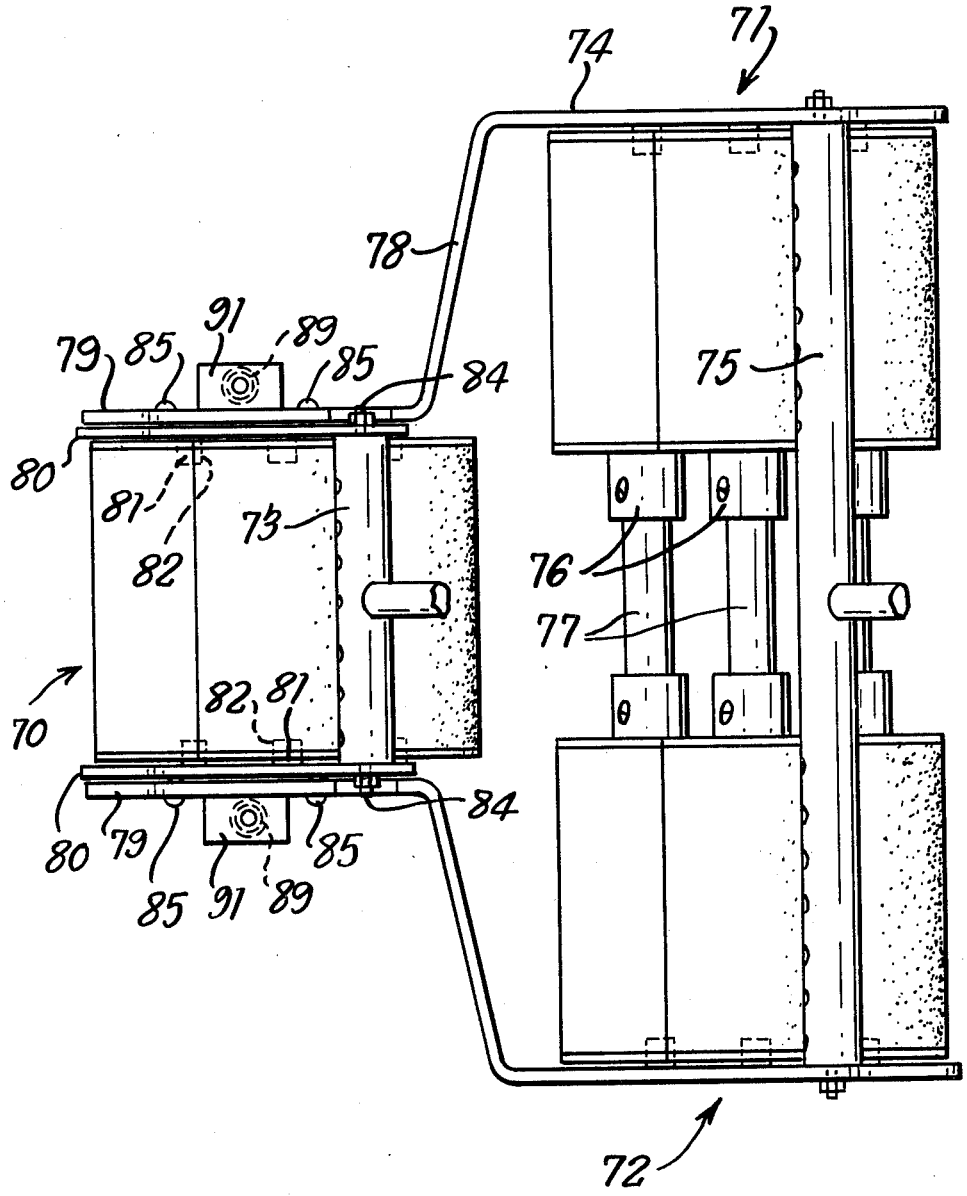
FIG. 7 is a plan view of the applicator of FIG. 6.
Figure 8:
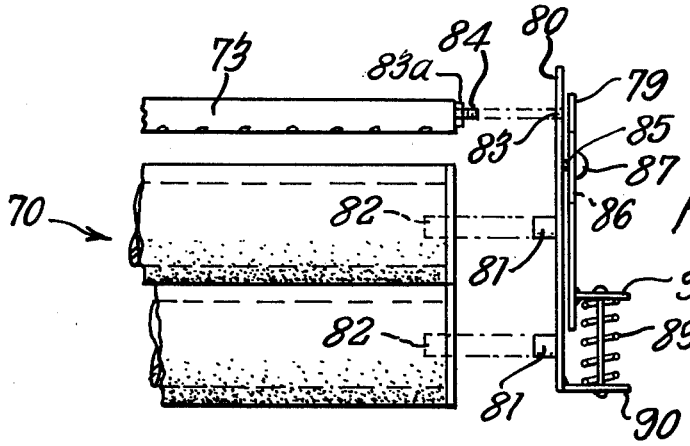
FIG. 8 is a front elevation of part of the fluid applicator of FIG. 6.

It can be seen from FIGS. 6 and 7 that each side plate 74 has an upwardly extending portion 78 which leads to a forwardly extending portion 79 which lies parallel to the respective side plate 80 of the front roller unit 70. The side plate 80 is provided with spigots 81 for mounting in recesses 82 in the rollers of the unit 70. The plate 80 also has square aperture 83 which receives the square member **83*a* of the spreader tube 73, and through which the screw-threaded member 84** passes.

In order to accommodate variations in the level of the surface to be marked, for example, where the ground is uneven, the front unit 70 is mounted independently of the rear units 71, 72. To this end, each side plate 80 of the front unit has a pair of outwardly projecting pins 85 which pass through vertical slots 86 in the forwardly extending portion 79 of the associated rear side plate 74. Nuts 87 are screwed onto the projecting ends of the pins 85 so as to permit the plates 80 to move vertically relative to the rear plates 79.

The relative movement between the front and rear plates is damped by means of springs 89 which are attached between an outwardly extending flange 90 at the lower edge of each plate 80 and an outwardly extending flange 91 on each plate 79.

This construction permits the front unit to rise and fall with respect to the rear units and to accommodate unevenness in the surface being marked.

Figure 9:
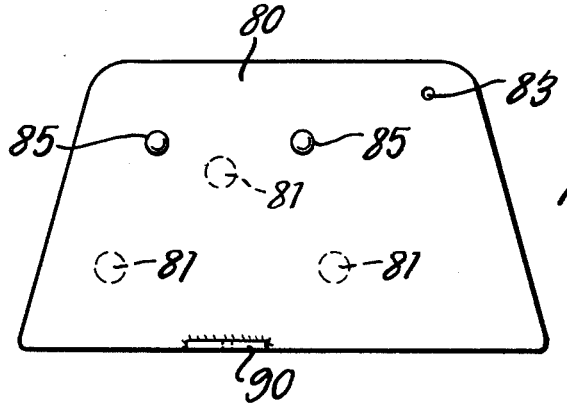
FIG. 9 is a side view of one of the side plates of the fluid applicator of FIG. 6.
Figure 10:
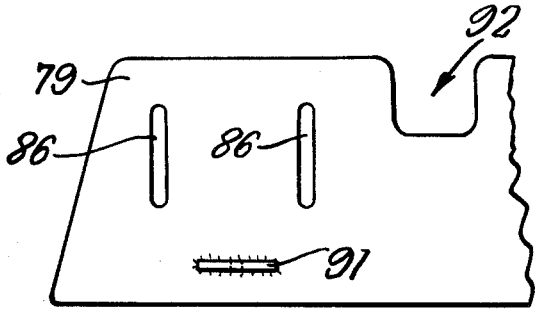
FIG. 10 is a side view of part of another side plate of the fluid applicator of FIG. 6.

To accommodate the member 84 and permit it to be attached to the plate 80 by means of the usual nuts, the portions 79 of the rear plates 74 are provided with recesses 92 as seen in FIG. 9.

Further modifications may be made to the embodiments described without departing from the scope of the invention claimed. For example, a fluid applicator may be provided with two triple roller units situated side-by-side, each unit being vertically movable with respect to the other so as to accommodate unevenness in the surface being marked.

What is claimed is:

1. A fluid applicator for applying fluid to a surface, comprising a reservoir for fluid, a fluid outlet in the reservoir, two side frame members, at least one roller assembly mounted between the side frame members, said assembly comprising at least two rollers, at least one of which is situated so as to receive fluid from the outlet, at least two of the rollers being arranged one behind the other so as to roll over the surface to be marked and to apply the fluid to the surface in a single line, each roller comprising a spindle and a cylindrical sleeve of an absorbent material removably mounted on the spindle, the ends of each spindle being journalled in respective side frame members, means releasably connecting at least one of said side frame members to said spindle whereby said side frame can be removed to permit said sleeve to be removed from a respective spindle for cleaning or replacement.

2. The fluid applicator of claim 1 wherein said two rollers of said roller assembly are situated so that one roller receives fluid from the outlet, means being provided for transferring the fluid from said one roller to the other roller.

3. The fluid applicator of claim 1 wherein said roller assembly includes an additional roller, said additional roller being mounted so that its periphery is in contact with the peripheries of the said two rollers, and which is situated to receive fluid from the outlet and to transfer it to the two rollers.

4. The fluid applicator of claim 1 including two roller assemblies, the rollers of the assemblies being arranged behind one another so as to roll over the surface to be marked and apply the fluid to the surface in a single line.

5. The fluid applicator of claim 1 including two roller assemblies, the assemblies being situated alongside one another.

6. The fluid applicator of claim 5 in which the spacing between the two roller assemblies is adjustable.

7. The fluid applicator of claim 5 including a third roller assembly mounted ahead of the two roller assemblies.

8. The fluid applicator of claim 4 wherein the one roller assembly is vertically movable with respect to the other one of said two roller assemblies.

9. The fluid applicator of claim 1 wherein said side frame members are secured together by a transverse rod extending therebetween and releasably secured to at least that one of said side frame members to which said spindle is releasably connected.

10. The fluid applicator of claim 1 wherein said outlet comprises a spreader tube positioned so as to supply fluid to the fluid receiving roller in a line parallel to the axis of the roller.

11. The fluid applicator of claim 10 wherein the outlet from the spreader tube comprises a plurality of spaced apertures.

12. The fluid applicator of claim 9 wherein said transverse rod comprises a spreader tube positioned to supply fluid to the fluid receiving roller.

13. The fluid applicator of claim 1 including a valve for opening and closing said fluid outlet.

14. The fluid applicator of claim 13 wherein said valve is adapted to be operated manually by means of a trigger.

15. The fluid applicator of claim 14 in which said trigger for operating said valve is mounted adjacent a handle for manual operation of the applicator.

16. The fluid applicator of claim 1 wherein said sleeve is of a foamed plastics material.

17. A fluid applicator for applying fluid to a surface, comprising a reservoir for fluid, fluid outlet means in the reservoir, and at least two roller assemblies, each assembly comprising at least two rollers one of which is situated to receive fluid from said outlet means, two of the rollers in each assembly being situated one behind the other so as to roll over the surface to be marked and to apply the fluid to the surface in a single line, means permitting one roller assembly to move vertically with respect to the other roller assembly away from a normal paint applying position to accommodate un-evenness in the surface being marked, and means biasing said one roller assembly toward said normal paint applying position.

18. The fluid applicator of claim 17 wherein one roller assembly is situated alongside the other.

19. The fluid applicator of claim 17 wherein one roller assembly is situated in front of the other.

20. The fluid applicator of claim 17, wherein said biasing means comprises spring means for damping the relative movement between said roller assemblies.

21. A fluid applicator for applying fluid to a surface, comprising reservoir for fluid, two side frame members, at least one roller assembly mounted between the side frame members and situated to apply fluid to said surface, said roller assembly including at least one roller having ends thereof journalled in the respective side frame members, at least one of said roller ends releasably journalled to its respective side frame member, a transverse rod extending between and secured to said side frame member, a transverse rod extending between and secured to said side frame members, a transverse rod being releasably secured to at least that one of said side frame members within which said roller end is releasably journalled, said transverse rod comprising a spreader tube positioned to receive fluid from said reservoir and to supply fluid to said roller assembly, whereby at least one of said side frame members can be removed from the respective transverse rod end and roller end for maintenance purposes.

* * * * *

UNITED STATES PATENT OFFICE

CERTIFICATE OF CORRECTION

PATENT NO. : 4,015,907

DATED : 5 April 1977

INVENTOR(S) : GUY BRYAN LODGE

It is certified that error appears in the above-identified patent and that said Letters Patent are hereby corrected as shown below:

Column 6, Claim 10

Line 9 (last line of claim 10) after the word "the", ---fluid receiving--- should be inserted.

Column 6, Claim 21

Line 48 (line 2 of claim 21) after the word "comprising" ---a--- should be inserted.

Line 53 (line 7 of claim 21) after the word "ends"---being--- should be inserted.

Lines 54, 55 and 56 (lines 8-10 of claim 21) the following should be omitted:

[a transverse rod extending between and secured to said side frame member,]

Line 57, (line 11 of claim 21) the word "a" should be omitted and the word ---said--- should be inserted.

Signed and Sealed this

Eighteenth Day of April 1978

[SEAL]

Attest:

RUTH C. MASON
Attesting Officer

LUTRELLE F. PARKER
Acting Commissioner of Patents and Trademarks